US007520250B2

(12) United States Patent
Leiss

(10) Patent No.: US 7,520,250 B2
(45) Date of Patent: Apr. 21, 2009

(54) CRANKCASE BREATHER ASSEMBLY

(75) Inventor: Daniel Leiss, Somerset, PA (US)

(73) Assignee: Jenny Products, Incorporated, Somerset, PA (US)

( * ) Notice: Subject to any disclaimer, the term of this patent is extended or adjusted under 35 U.S.C. 154(b) by 88 days.

(21) Appl. No.: 11/900,149

(22) Filed: Sep. 10, 2007

(65) Prior Publication Data

US 2009/0064948 A1 Mar. 12, 2009

(51) Int. Cl.
*F01M 13/00* (2006.01)

(52) U.S. Cl. ..... 123/41.86; 123/572

(58) Field of Classification Search ..... 123/572, 123/573, 574, 41.86
See application file for complete search history.

(56) References Cited

U.S. PATENT DOCUMENTS 5,881,686 A 3/1999 Schmidt
6,644,290 B2 * 11/2003 Yoneyama et al. ..... 123/572
2006/0254541 A1 11/2006 Nushart et al.

* cited by examiner

*Primary Examiner*—Noah Kamen
(74) *Attorney, Agent, or Firm*—Carothers & Carothers

(57) ABSTRACT

A breather assembly for ventilation and pressure control within a crankcase of a positive displacement motor or pump. The breather assembly includes an intake/exhaust port through the crankcase with a valve seat for the port on an exterior surface of the crankcase. A flexible valve membrane is positioned over the port on the valve seat on the exterior of the crankcase for flexing outwardly to exhaust air under positive pressure from the crankcase to atmosphere and to close the port when the crankcase pressure is neutral or negative. An irregular surface is provided on the face of the valve membrane facing to and engaging the valve seat and this surface is provided with a texture which permits air to flow over the valve seat and into the port in a controlled quantity when a negative air pressure condition is attained in the crankcase whereby a predetermined small vacuum level may be maintained in the crankcase. A filter is positioned over the membrane whereby air egressing from and ingressing into the crankcase from atmosphere to the port is filtered.

3 Claims, 2 Drawing Sheets

CRANKCASE BREATHER ASSEMBLY

BACKGROUND OF THE INVENTION

The present invention relates to a breather assembly for ventilation of the crankcase of a motor or pump. More particularly, the present invention relates to a breather assembly for the crankcase of a piston motor or pump to maintain pressure control within the crankcase.

During operation of a positive displacement pump, or engine, pressure variations within the crankcase occur. These pressure variations can produce inefficiencies or other operational problems within the pump or engine. To accommodate these pressure changes, crankcases are commonly fitted with a breather assembly. In most cases the breather assembly includes a filter that removes dirt or other debris from the air being draw into the crankcase and oil or other contaminates from the air that is being discharged.

Ideally, the pressure within the crankcase should be maintained at a low negative pressure level, as for example from between 1/16th to 1/6th psi, which equates to a vacuum level of approximately a negative 0.08 to a negative 0.15 psi.

It is a principal object of the present invention to provide a breather assembly which satisfies these conditions yet is simple in construction and inexpensive to manufacture and maintain.

SUMMARY OF THE INVENTION

The breather assembly of the present invention for ventilation and pressure control within a crankcase of a positive displacement motor or pump is comprised of an intake/exhaust port through the crankcase with a valve seat for the port on an exterior surface of the crankcase. A flexible valve membrane is positioned over this port on the valve seat on the exterior of the crankcase for flexing outwardly to exhaust air under positive pressure from the crankcase to atmosphere and to close the port when the crankcase pressure is neutral or negative. An irregular surface is provided on the face of this valve member which faces to and engages the valve seat. The irregular surface has a texture which permits air to flow over the valve seat and into the port in a controlled quantity when a negative air pressure condition is attained in the crankcase whereby a predetermined small vacuum level is maintained in the crankcase. A filter is positioned over the membrane whereby air egressing from and ingressing into the crankcase from atmosphere through the port is filtered.

The texture of the valve membrane is designed whereby the predetermined vacuum level in the crankcase is preferably maintained, though not definitely required, to be in the approximate range of a negative 0.08 to a negative 0.15 psi.

To provide fast response, the breather assembly may further include a closely spaced pair of these ports through the crankcase with a respective pair of valve seats, and the valve membrane is secured to the crankcase between these ports whereby the valve membrane overlies both of the ports on the respective valve seats.

BRIEF DESCRIPTION OF THE DRAWINGS

Other objects and advantages appear hereinafter in the following description and claims. The accompanying drawings show, for the purpose of exemplification, without limiting the scope of the invention or appended claims, certain practical embodiments of the present invention wherein:

DETAILED DESCRIPTION OF A PREFERRED EMBODIMENT

Figure 1:
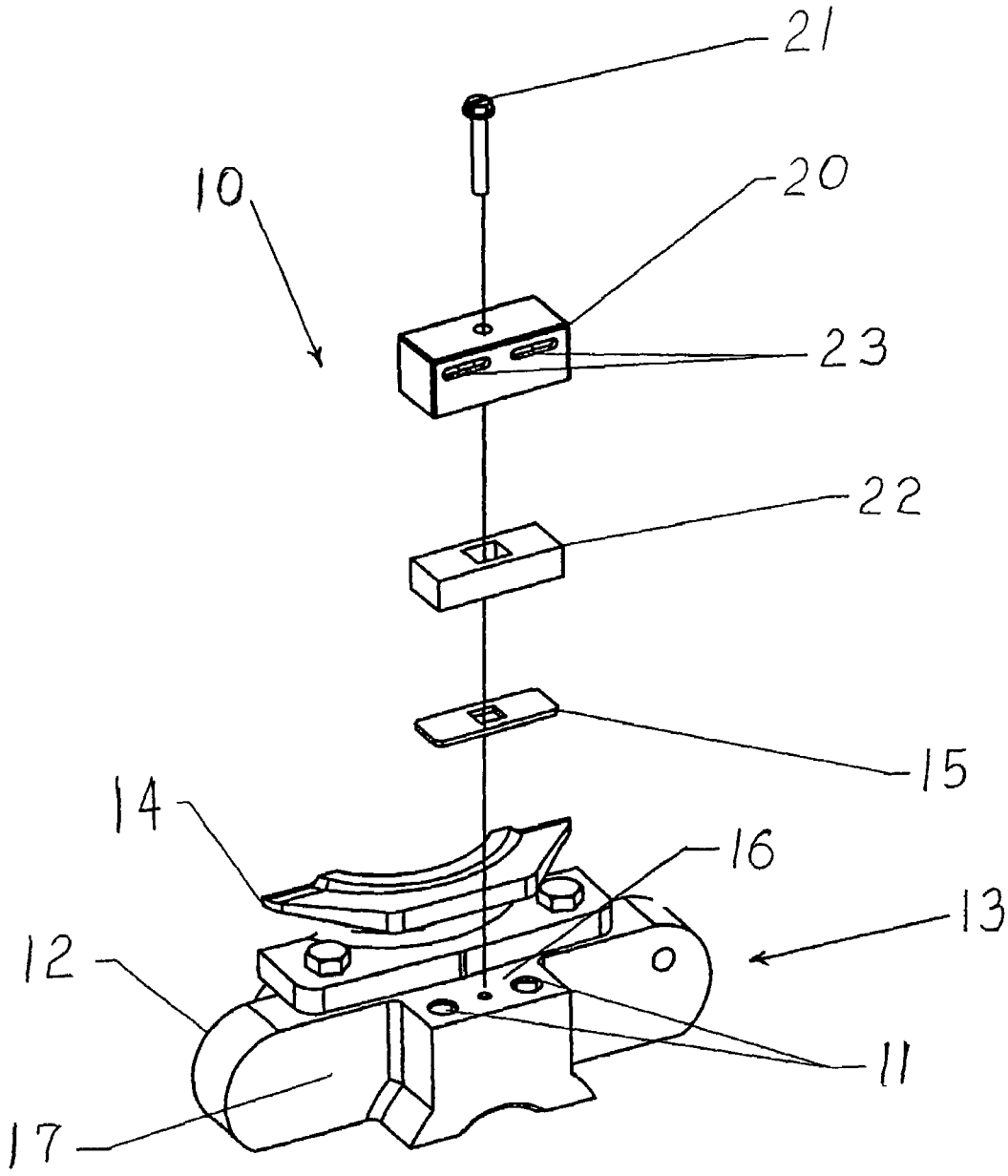
FIG. 1 is an exploded perspective view of the crankcase breather assembly of the present invention as applied to a compressor pump shown in partial section.
Figure 2:
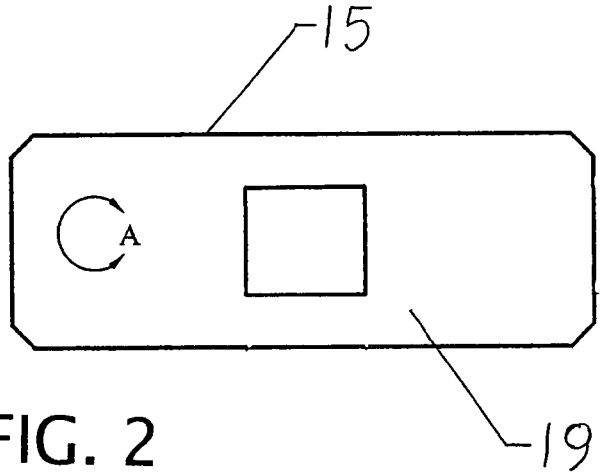
FIG. 2 is a bottom view of the flexible valve membrane portion of the breather assembly shown in FIG. 1.
Figure 3:
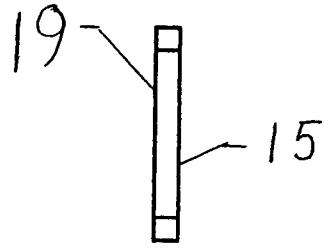
FIG. 3 is an end view of the membrane shown in FIG. 2.

Referring to the drawings, the breather assembly 10 of the present invention includes two intake/exhaust ports 11 which penetrate through crankcase 12 of compressor pump 13, which is a positive displacement pump including a reciprocating piston (not shown) of conventional type which reciprocates within cylinder 14. While the breather assembly of the present invention is illustrated for use on a pump, nevertheless the present invention is also applicable for a breather assembly to be used on a motor.

The breather assembly 10 further includes flexible valve membrane 15 which is positioned over port 11 on valve seat 16 on the exterior 17 of crankcase 12. Flexible valve membrane 15 is constructed of a flexible material, such as plastic or rubber. For example, it may be constructed of Buna N sheet rubber. The valve membrane 15 flexes outwardly to exhaust air under positive pressure from the crankcase 12 to atmosphere and to close the ports 11 when the crankcase pressure is neutral or negative.

Figure 4:
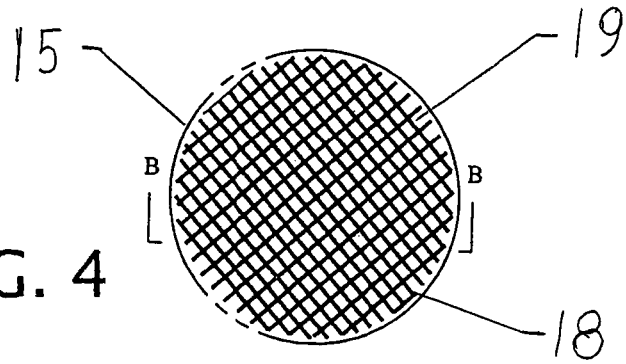
FIG. 4 is an enlarged view of the surface area A of the membrane shown in FIG. 2.
Figure 5:
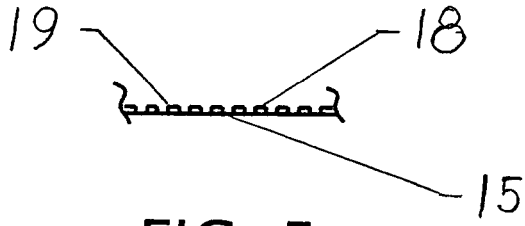
FIG. 5 is a sectional view in side elevation of the surface area shown in FIG. 4 as seen along section line B-B.

FIGS. 4 and 5 illustrate the texture or pattern on the bottom side 19 of valve membrane 15 thereby providing an irregular surface wherein the texture permits air to flow over the seat 16 into ports 11 in a control quantity when the valve is closed and a negative air pressure condition is attained in the crankcase 12, whereby a predetermined vacuum level is maintained in the crankcase. Accordingly, the flexible membrane prevents either a strong vacuum or a high crankcase pressure. This bottom surface texture 18 of bottom surface 19 is illustrated in an enlarged view in FIGS. 4 and 5. The texture 18 is provided in the form of a cross stitch pattern.

Flexible valve membrane 15 is maintained in position over ports 11 on valve seat 16 by means of the breather housing 20 which is secured to the crankcase 12 by machine screw 21. In addition, filter 22 is also retained in housing 20 over flexible valve membrane 15 by means of housing 20 in order to filter air egressing from and ingressing into the crankcase 12 from atmosphere through the ports 11.

The texture 18 of the bottom surface 19 of valve membrane 15 is designed to maintain a predetermined small vacuum level within the crankcase 12, for example, of an approximate range of a negative 0.08 to a negative 0.15 psi. Of course this texture may be varied to provide a different range if desired.

Housing 20 is provided with two air ports 23 for ingress and egress of air into breather housing 20.

I claim:

1. A breather assembly for ventilation and pressure control within a crankcase of a positive displacement motor or pump, the breather assembly comprising:

an intake/exhaust port through said crankcase with a valve seat for said port on an exterior surface of said crankcase;

a flexible valve membrane positioned over said port on said valve seat on the exterior of said crankcase for flexing outwardly to exhaust air under positive pressure from said crankcase to atmosphere and to close said port when the crankcase pressure is neutral or negative;

an irregular surface on a face of said valve membrane facing to and engaging said valve seat, said irregular surface having a texture which permits air to flow over said seat and into said port in a controlled quantity when a negative air pressure condition is attained in said crankcase whereby a predetermined vacuum level is maintained in said crankcase; and a filter positioned over said membrane whereby air egressing from and ingressing into said crankcase from atmosphere through said port is filtered.

2. The breather assembly of claim 1, wherein said predetermined vacuum level is in the approximate range of a negative 0.08 to a negative 0.15 psi.

3. The breather assembly of claim 1, including a closely spaced pair of said ports through said crankcase with a respective pair of said valve seats, and said valve membrane secured to said crankcase between said ports whereby said valve membrane overlies both of said ports on said respective valve seats.

* * * * *